United States Patent [19]

Ciccarelli

[11] 4,210,056

[45] Jul. 1, 1980

[54] VALVE CONSTRUCTION FOR BRASS WIND INSTRUMENT

[76] Inventor: Ronald R. Ciccarelli, 5730 Howe St., Pittsburgh, Pa. 15232

[21] Appl. No.: 923,540

[22] Filed: Jul. 11, 1978

[51] Int. Cl.[2] ..... G10D 9/04

[52] U.S. Cl. ..... 84/392

[58] Field of Search ..... 84/288–292

[56] References Cited

U.S. PATENT DOCUMENTS

| | | | |
|---|---|---|---|
| 2,665,606 | 1/1954 | Wohlrab | 84/392 |
| 3,835,748 | 9/1974 | Olson | 84/388 |
| 4,095,504 | 6/1978 | Hirsbrunner | 84/390 |

FOREIGN PATENT DOCUMENTS

| | | | |
|---|---|---|---|
| 1354978 | 2/1964 | France | 84/392 |
| 1140117 | 1/1969 | United Kingdom | 84/388 |

*Primary Examiner*—Lawrence R. Franklin

*Attorney, Agent, or Firm*—Buell, Blenko & Ziesenheim

[57] ABSTRACT

An improved piston valve construction for valved wind instruments such as trumpets, bugles, and the like is provided having portions of varying diameter which may be employed in conventional piston valve casings. Such improved valve construction comprises a ported lower piston portion of non-metallic composition selected from certain thermoplastic and thermosetting polymeric compositions. In one aspect a non-lubricated piston valve assembly for valved wind instruments is provided. Preferred polymeric compositions include lubrous, hydrophobic, non-swelling polymers, especially high density polyethylene, polypropylene, impact-resistant styrene-butadiene copolymers, acetal resins, and the like.

8 Claims, 3 Drawing Figures

VALVE CONSTRUCTION FOR BRASS WIND INSTRUMENT

This invention relates to an improved valve construction for brass wind instruments, and more particularly to brass, valved-wind instruments having a reciprocating piston valve within a valve casing such as trumpets, cornets, bugles and the like Conventional valved wind instruments include a plurality of piston valves each reciprocally movable within a valve casing. Each piston valve is generally comprised of two or more hollow cylindrical sections of varying diameter. The lowermost section of such valves includes piston ports or openings, six ports altogether according to conventional practice. Such piston ports are interconnected in pairs by internal tube means, such as copper tubing. The interconnection of the piston ports in a valve wind instrument is such that when the piston valve assembly is depressed while playing the instrument one or more of the open ports is positioned in line with cooperating ports or apertures formed in a valve casing to allow air to pass through the instrument tubing and out its bell to form musical notes. Connected to the lowermost cylindrical section of the piston valve is a second cylindrical section of diameter smaller than the lowermost section. This section generally serves to guide and support spring means for urging the piston valve assembly to return to a "rest" position after depression during playing of the instrument. This section of the piston valve, according to conventional practice, is generally threaded at its uppermost end to receive and engage a valve stem which, in turn may pass through a valve cap and carrying a finger pad for depressing the valved wind instrument.

Heretofore, the piston valve body has been manufactured by a rather elaborate and expensive process. The lowermost portion of the piston valve is formed by a method involving precisely mounting sections of internal tubing on a jig means and forming thereover a brass casing or shell to thereby form a hollow cylindrical portion having external piston ports interconnected in pairs by the internal tubes. At the same time, the brass casing is also formed over upper and lower cap portions provided for the lowermost piston assembly. The upper cap portion may carry, during the cylindrical shell forming operation, the hollow spring guiding (piston rod) portion of the piston valve according to conventional practice. The piston valve assembly sections thereby formed are subjected to final finish machining and may thereafter be fitted with valve spring means, valve stems, and valve caps, etc. and be fitted for use in a valve casing in a particular horn.

Due largely to the method of manufacture of such piston valves and the fact that several rather imprecise parts are employed in assemblying a completed piston valve for insertion in a valve casing, it is, as a practical matter, not possible to form a conventional valve which is entirely concentric around a center line through the piston valve assembly. For that reason, a conventional top guided piston tends to tilt slightly in the valve casing and, therefore, wear along its extreme lower and upper portions. Moreover, a lubricant is required between a piston valve and its respective casing, and the eccentricity of conventional piston valves increase the difficulty of maintaining a proper clearance between the piston valve and its casing and results in improper lubrication of the assembly. Unless great care is devoted to the manufacture of a conventional valve, leaky parts and improper air flow through the valve can result.

Such prior art valves have been difficult to make and accordingly relatively expensive. In addition, they were difficult to lubricate and tended to stick and wear out of round as discussed above.

There have been proposed a great variety of solutions to these many problems of prior art valves. In an effort to reduce the problems of lubrication, it has been proposed to use lubricant grooves and the like as, for example, in U.S. Pats. Nos. 2,260,723 and 2,511,255. The problems of assembly have brought forth U.S. Pats. Nos. 3,044,126 and 3,835,748 which provide plastic parts with metal sliding shell surfaces. The art has attempted to solve the problem of out-of-line movement and wear with a variety of structures modifying the piston tops. For example, U.S. Pat. No. 2,798,401 discloses a valve assembly for brass wind instruments including a pilot guide rod for the valve assembly for maintaining a valve piston in a more vertical alignment with respect to its reciprocating motion in a valve casing. The arrangement there, however, still requires the elaborate assembly techniques required as hereinabove described. U.S. Pat. No. 3,030,846 also discloses an improved valve similar to that of U.S. Pat. No. 2,798,401 wherein a top-mounted guide means is provided including a cup-like plastic barrel sleeve within the valve casing. There, the barrel sleeve is keyed to the valve casing so that the valve piston is indexed against angular movement by a keyed valve stem, or post, adapted to be slidably received in a shaped closure portion of the barrel sleeve. A piston guide key arrangement is also shown in U.S. Pat. No. 3,044,339. The foregoing all are, more or less, guide-means additions to conventional valves which suffer the drawbacks in assembly and manufacture heretofore defined with respect to all conventional valves. Moreover, all the foregoing require the use of lubricants between valve piston and valve casing and must be maintained rather studiously to avoid "freezing" of the valve piston within the casing due to improper lubrication maintenance.

This invention provides an improved piston valve construction for valved wind instruments having reciprocating piston valves within a valve casing. The invention provides a piston valve of the type described having concentric construction, which may be constructed without the detailed fabrication and assembly techniques heretofore required for such valves. Further provided is a method of forming the piston valve of the invention in a more economical fashion than has heretofore been possible for constructing conventional piston valves for valve wind instruments. In certain preferred aspects, the invention provides a piston valve and valve casing assembly for brass wind instruments which does not require the use of a lubricant between piston valve and valve casing. These and other advantages of the invention will become apparent by reference to the appended drawings and as the following description thereof proceeds. A piston valve, preferably of unitary composition and construction, is provided having portions of varying diameter which may be employed in conventional piston valve casings. Said improved valve construction comprises ported pistons of a non-metallic composition selected from certain thermoplastic and thermosetting polymeric compositions. Preferred polymeric compositions include ultra-high molecular weight high density polyethylene, polypropylene, impact resistant styrene-butadiene copolymers, acetal resins, fluorocarbon resins such as "Teflon" and the like.

In the foregoing general description, I have set out certain objects, purposes and advantages of the present invention. Other objects, purposes and advantages of this invention will, however, be apparent from a consideration of the following description and the accompanying drawings in which, FIG. 1 is a side elevation of a preferred piston valve according to the invention;

Figure 1:
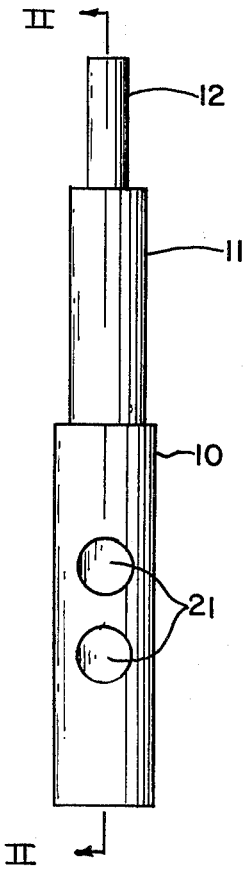

Referring now to FIG. 1 a piston valve according to the invention is shown. The piston valve includes lower piston portion 10, piston rod portion 11, and stem portion 12. The construction shown is according to conventional practice, and it is to be understood that the overall configuration of the piston valve may vary somewhat from that shown in the figures to accommodate various styles of valve cylinders. Piston portion 10, piston rod portion 11, and stem portion 12, of the piston valve shown comprise a single piece of unitary composition comprising a non-metallic thermoplastic or thermosetting polymeric composition. Polymeric compositions useful in the invention must be essentially hydrophobic and non-swelling upon exposure to moisture. In playing valved-wind instruments moisture in the form of saliva or perspiration finds it way into the valve structure. If the piston valve is susceptible to absorbing water, it may tend to bind in the valve casing. Moreover, should the piston valve assembly swell, either due to exposure to water or other factors, such as aging or material fatigue, the piston valve can likewise bind in its casing. The polymeric materials useful in the invention have a low coefficient of sliding friction, most preferably a coefficient of friction less than that of brass on brass. Polymeric compositions useful in the invention likewise have outstanding abrasion resistance. It is also preferred, and essential in the case of a non-lubricated piston valve assembly according to the invention, that the polymeric material employed for forming the piston valve have self-lubricating properties. Preferred polymeric compositions are high density polyethylene, polypropylene, impact-resistant styrene-butadiene copolymers, acetal resins, and the like. Especially preferred materials include the ultra-high molecular weight high density polyethylene sold under the trade name "HI-FAX 1900". Another preferred composition is the acetal resin sold under the trade name "DELEIN". Both polymers have low coefficients of sliding friction, outstanding abrasion resistance, good dimensional stability, are non-swelling, and are not adversely affected by exposure to moisture. It will be appreciated that as a practical matter the use of such materials in forming a piston valve according to the invention virtually eliminates corrosion problems in piston valve (control) section of a valved wind instrument.

Figure 2:
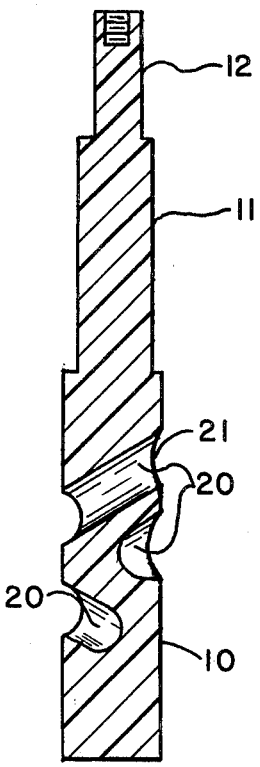
FIG. 2 is a cross-section of the valve through line II—II of FIG. 1.

Referring now to FIG. 2 a sectional view along line II—II of FIG. 1 is shown which best depicts the unitary composition construction of the piston valve of the invention. As shown there the piston valve according to the invention is essentially a solid homogeneous structure having passageways 20 formed integrally within piston portion 10. Passageways 20 serve to interconnect in pairs piston ports 21 of piston portion 10. Piston ports 21 and passageways 20 may be formed in the piston valves of the invention during manufacture of the piston valve. For example, the piston valves may be formed by a molding process, such as an injection molding process, wherein a polymeric molding powder of the type described hereinabove is injected into a mold cavity of the desired shape, under heat and pressure, molded and cooled to form a piston valve of selected overall shape. In that case rods may be provided in the molding machine for extending into the mold cavity during the molding of molten polymer and withdrawn after the molded piston has been allowed to solidify to thereby form piston ports 21 and passageways 20 in the molded piston valve. Alternatively, passageways and ports may be melted out of a blank piston valve by means of a heated probe, or may be machined into the valve structure. Another alternative, though not preferred, means for forming the unitary composition piston valves of the invention is the machining of a solid rod of desired polymeric composition to form a blank piston valve followed by formation of ports and passageways therein as by machining or melting. Piston valves formed by any of the foregoing methods are ready for assembly in a valved wind instrument with little or no finish machining.

It will be appreciated here that the piston valves of the invention provide, in a preferred form, an improved piston valve construction in solid form, save for piston passageways and ports. Such solid-constructed piston valves allow ready manufacture of an entirely concentric piston valve assembly, which when activated in the valve casing of a valved wind instrument has little or no tendency to tilt or bend during reciprocating motion. It is believed that the concentricity obtainable in a piston valve according to the invention will allow a longer useful piston valve life than has heretofore been known. Moreover, choice of polymers as hereinabove described permits construction of a non-lubricated piston valve assembly for valved wind instruments which assembly is more economical to form, and which is substantially free of maintenance required in conventional piston valve assembly due to improper or inadequate lubrication.

Figure 3:
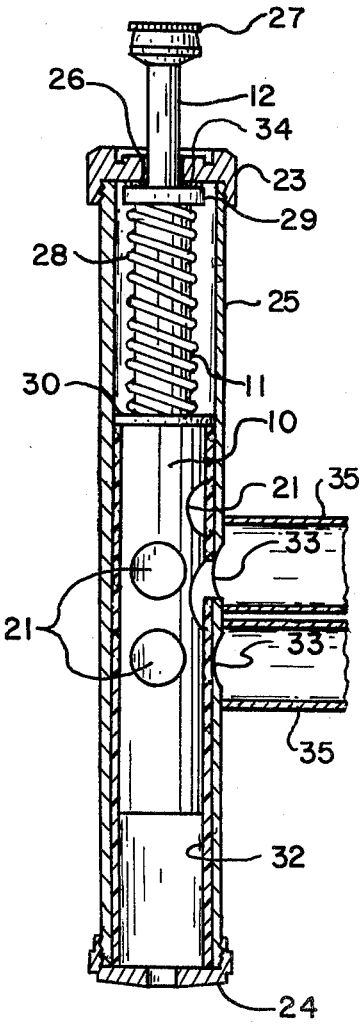
FIG. 3 is a piston valve and valve casing, partly in section, employing the improved valve construction of the invention.

FIG. 3 illustrates an assembled piston valve and valve casing for valve wind instruments according to the invention. In FIG. 3 valve casing 25 is shown having top valve cap 23 and bottom valve cap 24 threadably fixed thereto. Valve casing 25 encloses a piston valve having piston portion 10, a combined piston rod portion 11 and stem portion 12. Portion 12 extends through an opening 26 in top cap 23 and has mounted thereon finger pad means 27 of conventional form. Coil spring means 28 is provided surrounding the rod portion 11. Coil spring means 28 is compressed between opposed upper and lower spring guide washers 29 and 30 respectively. Upper spring guide washer 29 is rigidly affixed to piston valve portion 12. Lower spring guide washer 30 rests upon shoulder 31 formed integrally of valve casing 25 by the top of liner 32. Depression of finger cap 27 causes downward movement of piston valve portions 10, 11 and 12 and compression of spring means 28. Such downward movement allows piston ports 21 to become in line with cooperating ports, or apertures 33 provided in valve case 25 and liner 32 to regulate the flow or air through the instrument tubing 35 to produce desired musical notes. A resilient compliant washer 34 may be provided to cushion the return of the piston valve to its undepressed or "rest" position.

In the embodiment of the invention illustrated in FIG. 3 a thin non-metallic sleeve or liner 32 is provided within valve casing 25. Sleeve 32 may be comprised of the same or similar composition as that of piston valve portion 10. Sleeve 32 is especially useful, though not always required, in non-lubricated piston valve assemblies. Sleeves 32 selected from thermoplastic or thermosetting polymeric compositions of the type described tend to be somewhat compliant and aid in maintaining an efficient seal with reciprocating piston valve portion 10. It has been found that even without sleeve 32, it is possible to maintain an excellent seal in non-lubricated piston valve assemblies according to the invention comprising "DELRIN" and "HI-FAX" unitary piston valves in conventional brass casings.

The foregoing has described the improved unitary piston valve construction of the invention and certain preferred embodiments thereof. It is to be understood, however, that the invention is not necessarily limited to the expressed embodiments disclosed therein, but may be practiced variously within the scope of the appended claims.

I claim:

1. A piston valve for a valved wind instrument such as a trumpet, cornet or the like comprising a piston valve having portions of varying diameter including a ported lower piston portion having generally superposed transverse passages in sliding contact in a valve casing of said instrument and a piston rod portion fixed to said lower piston portion, said lower piston portion comprising a non-metallic lubrous, hydrophobic, non-swelling polymeric composition selected from the group consisting of thermoplastic and thermosetting polymeric compositions.

2. A piston valve as claimed in claim 1 wherein the lower piston portion and piston rod portion are of unitary construction and composition.

3. A piston valve for a valved wind instrument as set forth in claims 1 or 2 wherein said piston portion includes pairs of piston ports, each said pair of piston ports interconnected by means of passageways formed integrally of said piston portion.

4. A piston valve as set forth in claim 3 wherein said polymeric composition is selected from high-density polyethylene, polypropylene, impact-resistant styrene-butadiene copolymers, flurocarbon resins and acetal resins.

5. A piston valve assembly for a valved wind instrument such as a trumpet, cornet or the like including a valve casing having a piston valve reciprocally movable therein, said piston valve comprising a piston valve having portions of varying diameter including a lower piston portion and piston rod portion fixed to said lower piston portion, said lower piston portion comprising a non-metallic polymeric composition selected from the group consisting of thermoplastic and thermosetting polymeric compositions, and a cylindrical inner liner in said valve casing within which said lower piston sealingly reciprocates, said inner liner comprising a non-metallic polymeric composition selected from the group consisting of thermoplastic and thermosetting polymeric compositions.

6. A piston valve assembly for a valved wind instrument as claimed in claim 5 wherein the piston valve is of unitary composition and construction.

7. A piston valve assembly as claimed in claims 5 or 6 wherein said lower piston portion includes pairs of piston ports, each pair of piston ports interconnected by means of passageways formed integrally of said lower piston portion.

8. A piston valve assembly as claimed in claim 7 wherein said polymeric composition is selected from high-density polyethylene, polypropylene, impact-resistant styrene-butadiene copolymers, fluorocarbon resins and acetal resins.

* * * * *

UNITED STATES PATENT AND TRADEMARK OFFICE

CERTIFICATE OF CORRECTION

PATENT NO. : 4,210,056

DATED : July 1, 1980

INVENTOR(S) : RONALD R. CICCARELLI

It is certified that error appears in the above-identified patent and that said Letters Patent are hereby corrected as shown below:

Column 3, line 52, "DELEIN" should read --DELRIN--.

Signed and Sealed this

*Twenty-eighth* Day of *October 1980*

[SEAL]

*Attest:*

SIDNEY A. DIAMOND

*Attesting Officer*

*Commissioner of Patents and Trademarks*